US011072995B2

(12) United States Patent
Cannon et al.

(10) Patent No.: US 11,072,995 B2
(45) Date of Patent: Jul. 27, 2021

(54) VALVE APPARATUS

(71) Applicant: Downing Wellhead Equipment, LLC, Oklahoma City, OK (US)

(72) Inventors: Nicholas J. Cannon, Washington, OK (US); Ronnie B. Beason, Lexington, OK (US); Joel H. Young, Lexington, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 0 days.

(21) Appl. No.: 16/721,203

(22) Filed: Dec. 19, 2019

(65) Prior Publication Data

US 2020/0123876 A1 Apr. 23, 2020

Related U.S. Application Data

(63) Continuation of application No. 15/487,785, filed on Apr. 14, 2017, now Pat. No. 10,662,740.
(Continued)

(51) Int. Cl.
*E21B 34/10* (2006.01)
*E21B 33/068* (2006.01)
*E21B 34/14* (2006.01)

(52) U.S. Cl.
CPC ..... *E21B 34/101* (2013.01); *E21B 33/068* (2013.01); *E21B 34/14* (2013.01); *E21B 2200/05* (2020.05)

(58) Field of Classification Search
CPC ..... E21B 33/068; E21B 34/101; E21B 34/14; E21B 2200/05
See application file for complete search history.

(56) References Cited

U.S. PATENT DOCUMENTS 4,063,594 A 12/1977 Canterbury
4,457,376 A 7/1984 Carmody et al.
(Continued)

FOREIGN PATENT DOCUMENTS

WO 2014147032 9/2014

OTHER PUBLICATIONS

International Search Report and Written Opinion; PCT/US2017/027687 dated Sep. 8, 2017, 15 pages.

*Primary Examiner* — Christopher J Sebesta
(74) *Attorney, Agent, or Firm* — Fish & Richardson P.C.

(57) ABSTRACT

A valve apparatus that includes a first containment area having a fluid disposed therein at a first fluid pressure and a second containment area disposed below the first containment area having a fluid disposed therein at a selective fluid pressure where the selective fluid pressure can be increased and decreased, the second containment area in fluid communication with the first containment area. The valve apparatus also includes a valve disposed between the fluid in the second containment area at the selective fluid pressure and the fluid in the first containment area at the first fluid pressure. The valve apparatus includes a third containment area disposed below the second containment area having a fluid disposed therein at a third fluid pressure wherein the third fluid pressure is higher than the first fluid pressure, the second containment area in fluid communication with the third containment area. Furthermore, the valve apparatus includes a second valve disposed between the fluid in the third containment area at the third fluid pressure and the fluid in the second containment area at the selective fluid pressure. A method for passing an object through the valve apparatus from a low pressure area to a high pressure system.

25 Claims, 10 Drawing Sheets

Related U.S. Application Data

(60) Provisional application No. 62/322,305, filed on Apr. 14, 2016.

(56) References Cited

U.S. PATENT DOCUMENTS

| | | | | |
|---|---|---|---|---|
| 4,729,432 | A | 3/1988 | Helms | |
| 5,996,695 | A | 12/1999 | Koleilat et al. | |
| 6,065,542 | A | 5/2000 | Lalor et al. | |
| 6,095,242 | A | 8/2000 | Lequang et al. | |
| 6,170,573 | B1 | 1/2001 | Brunet et al. | |
| 6,227,299 | B1 | 5/2001 | Dennistoun | |
| 6,805,200 | B2 | 10/2004 | DeBerry | |
| 7,134,490 | B2 | 11/2006 | Nguyen | |
| 8,196,649 | B2 | 6/2012 | Allen et al. | |
| 8,261,837 | B2 | 9/2012 | Leonard et al. | |
| 8,424,607 | B2 | 4/2013 | Springett et al. | |
| 8,479,824 | B2 | 7/2013 | Travis et al. | |
| 8,511,393 | B2 | 8/2013 | Nguyen | |
| 8,668,020 | B2 | 3/2014 | Guitierrez et al. | |
| 8,960,276 | B2 | 2/2015 | Lang et al. | |
| 9,038,712 | B1 | 5/2015 | Streety et al. | |
| 9,085,950 | B2 | 7/2015 | Spacek | |
| 9,464,496 | B2 | 10/2016 | O Rourke et al. | |
| RE46,241 | E | 12/2016 | Cain et al. | |
| 9,534,465 | B2 | 1/2017 | Nguyen et al. | |
| 9,702,211 | B2 | 7/2017 | Tinnen | |
| 9,745,816 | B2 | 8/2017 | Milne et al. | |
| 10,662,740 | B2 | 5/2020 | Cannon et al. | |
| 10,689,938 | B2 | 6/2020 | Beason et al. | |
| 2002/0185276 | A1 | 12/2002 | Muller | |
| 2003/0178199 | A1* | 9/2003 | Deaton | E21B 34/06 166/332.8 |
| 2006/0124314 | A1 | 6/2006 | Haheim et al. | |
| 2007/0227743 | A1 | 10/2007 | Dallas | |
| 2008/0029262 | A1* | 2/2008 | Claxton | F16L 55/46 166/75.15 |
| 2008/0087439 | A1 | 4/2008 | Dallas | |
| 2008/0173441 | A1 | 7/2008 | Bowles et al. | |
| 2008/0277122 | A1 | 11/2008 | Tinnen | |
| 2012/0152564 | A1* | 6/2012 | Peltier | E21B 34/02 166/373 |
| 2013/0098632 | A1 | 4/2013 | Wetzel et al. | |
| 2013/0284432 | A1 | 10/2013 | MacPhail et al. | |
| 2014/0048255 | A1* | 2/2014 | Baca | E21B 34/02 166/250.1 |
| 2014/0158380 | A1 | 6/2014 | Varkey et al. | |
| 2014/0196906 | A1 | 7/2014 | Elenburg et al. | |
| 2014/0209299 | A1* | 7/2014 | Shah | E21B 19/00 166/250.01 |
| 2014/0246189 | A1* | 9/2014 | Beason | E21B 33/068 166/75.15 |
| 2014/0360720 | A1* | 12/2014 | Corbeil | E21B 33/068 166/284 |
| 2015/0240966 | A1* | 8/2015 | Kuehn | G05D 9/12 137/429 |
| 2015/0300106 | A1* | 10/2015 | Martin | E21B 17/1028 166/382 |
| 2016/0290087 | A1 | 10/2016 | Cherewrk | |
| 2017/0101840 | A1 | 4/2017 | Kauffmann et al. | |
| 2017/0204702 | A1 | 7/2017 | Hansen | |
| 2017/0298708 | A1 | 10/2017 | Cannon et al. | |

* cited by examiner

VALVE APPARATUS

CROSS-REFERENCE TO RELATED APPLICATIONS

This application is a continuation of and claims the benefit, under 35 U.S.C. § 120, of U.S. application Ser. No. 15/487,785, filed Apr. 14, 2017, which itself claims the benefit of U.S. Provisional Application Ser. No. 62/322,305, filed Apr. 14, 2016, under 35 U.S.C. § 119(e), the disclosures of both of which are hereby expressly incorporated herein by reference.

SPONSORED RESEARCH OR DEVELOPMENT

Not applicable.

BACKGROUND OF THE DISCLOSURE

1. Field of the Invention

The present disclosure relates to a valve apparatus for efficiently passing an object from a low pressure area (such as atmospheric conditions) to a high pressure system.

2. Description of the Related Art

Many obstacles are encountered when attempting to pass an object from a low pressure area into a high pressure system while maintaining pressure h the high pressure system.

Accordingly, there is a need for an apparatus that can pass an object from a low pressure area to a high pressure system more efficiently.

SUMMARY OF THE INVENTION

The present disclosure is directed to a valve apparatus that includes a first containment area having a fluid disposed therein at a first fluid pressure and a second containment area disposed below the first containment area having a fluid disposed therein at a selective fluid pressure where the selective fluid pressure can be increased and decreased, the second containment area in fluid communication with the first containment area. The valve apparatus also includes a valve disposed between the fluid in the second containment area at the selective fluid pressure and the fluid in the first containment area at the first fluid pressure. The valve apparatus includes a third containment area disposed below the second containment area having a fluid disposed therein at a third fluid pressure wherein the third fluid pressure is higher than the first fluid pressure, the second containment area in fluid communication with the third containment area. Furthermore, the valve apparatus includes a second valve disposed between the fluid in the third containment area at the third fluid pressure and the fluid in the second containment area at the selective fluid pressure.

The present disclosure is further directed toward a method for passing an object through the valve apparatus from a low pressure area to a high pressure system.

DETAILED DESCRIPTION OF THE DISCLOSURE

Figure 1:
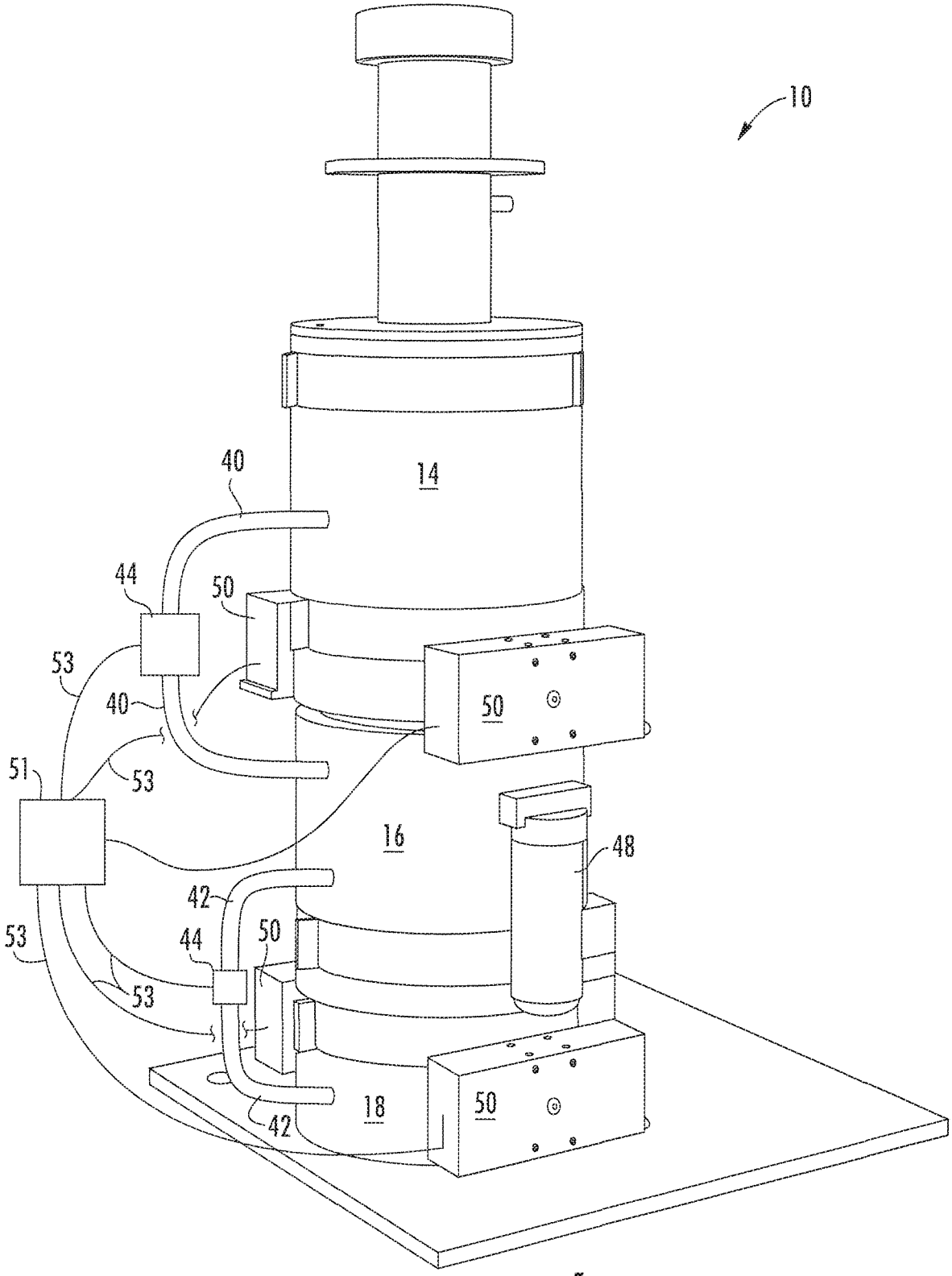
FIG. 1 is a side elevation view of a valve apparatus constructed in accordance with the present disclosure.
Figure 2:
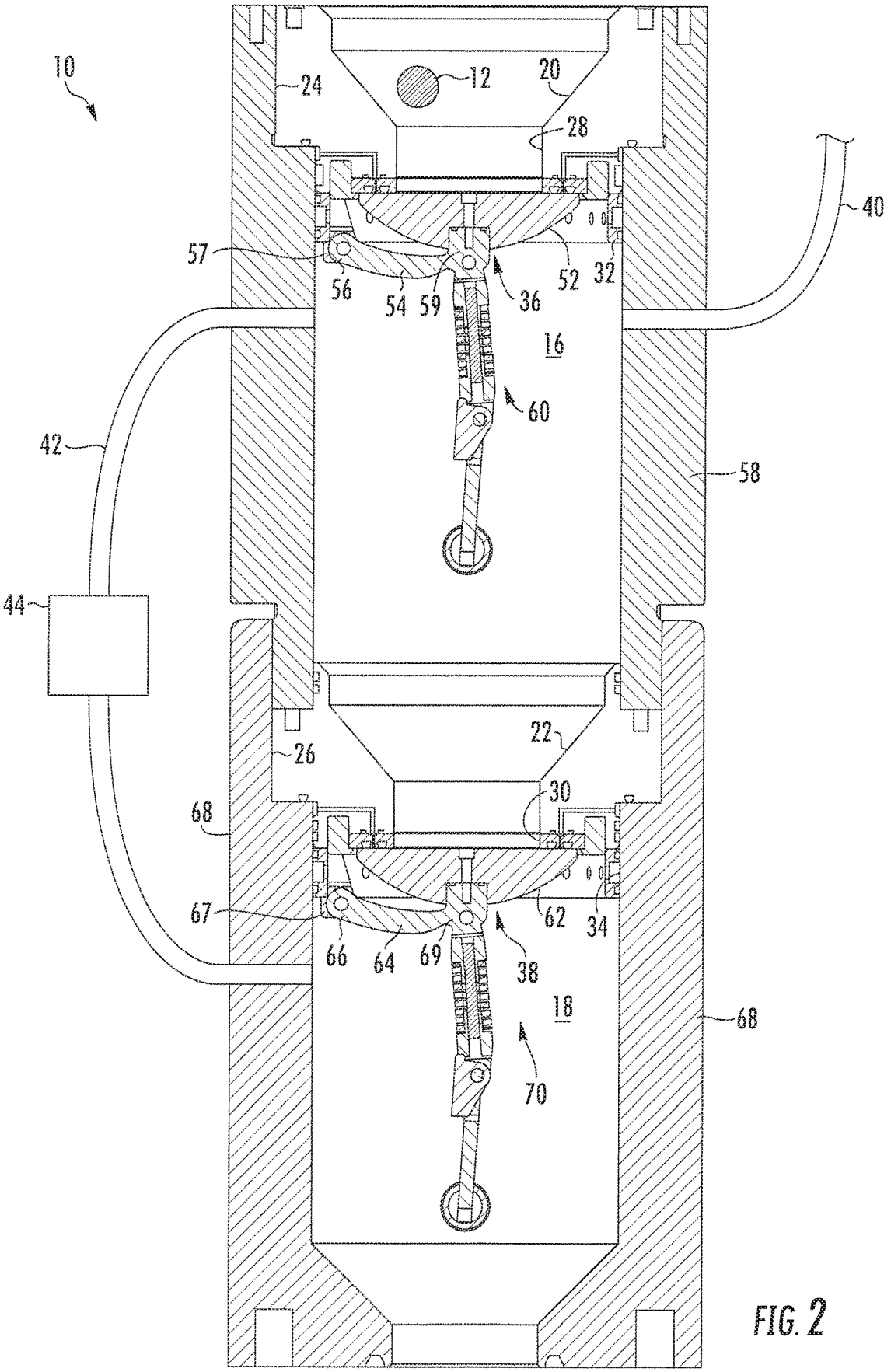
FIGS. 2-4 are cross-sectional views of the valve apparatus in various stages of operation and constructed in accordance with the present disclosure.
Figure 3:
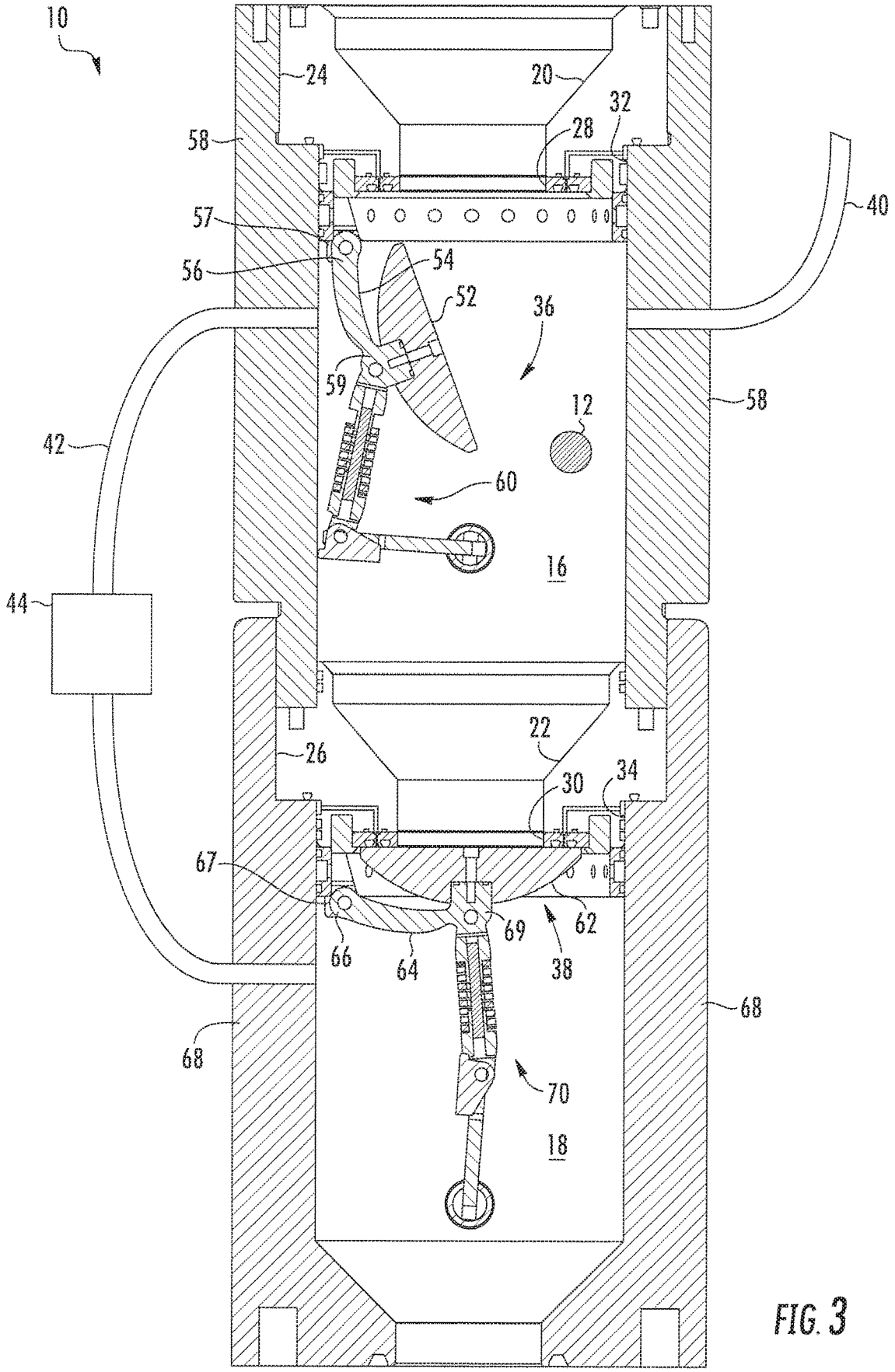
Figure 4:
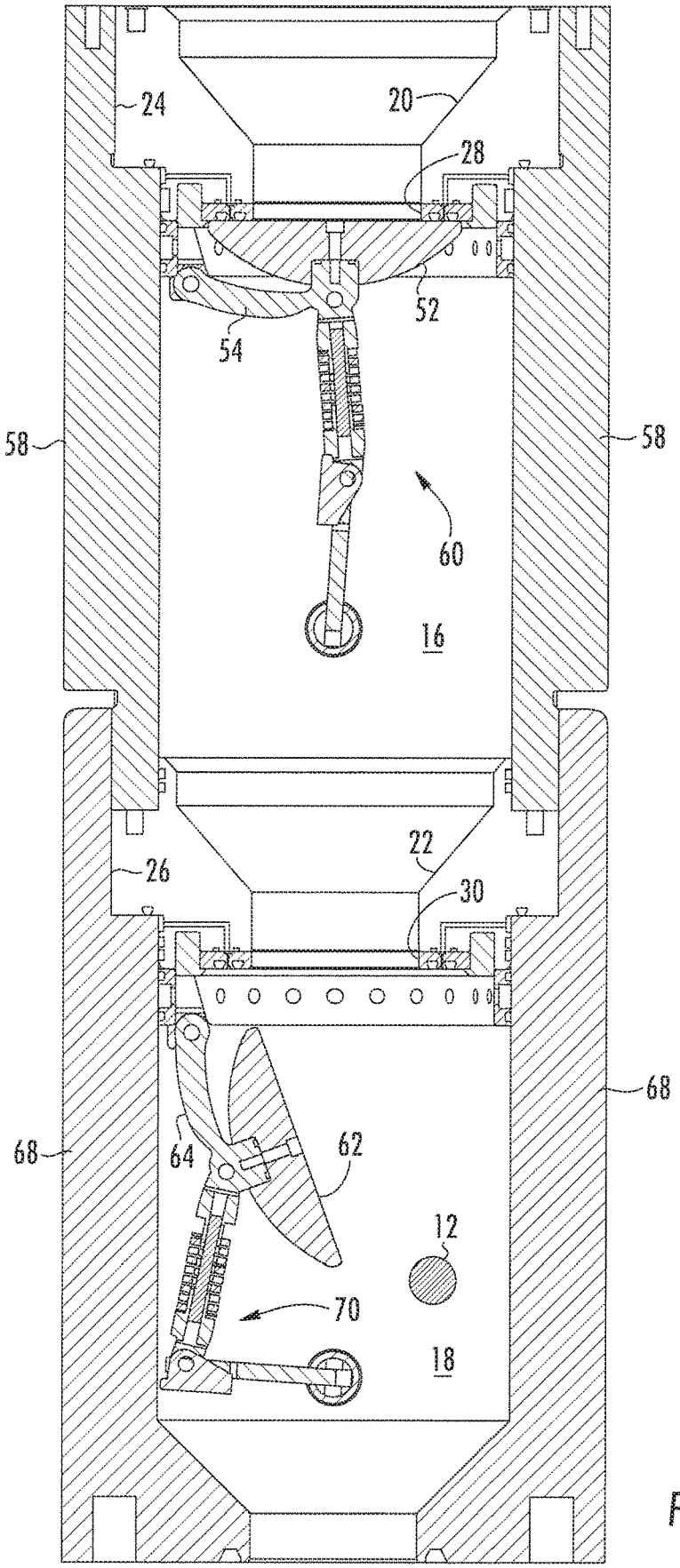
Figure 5A:
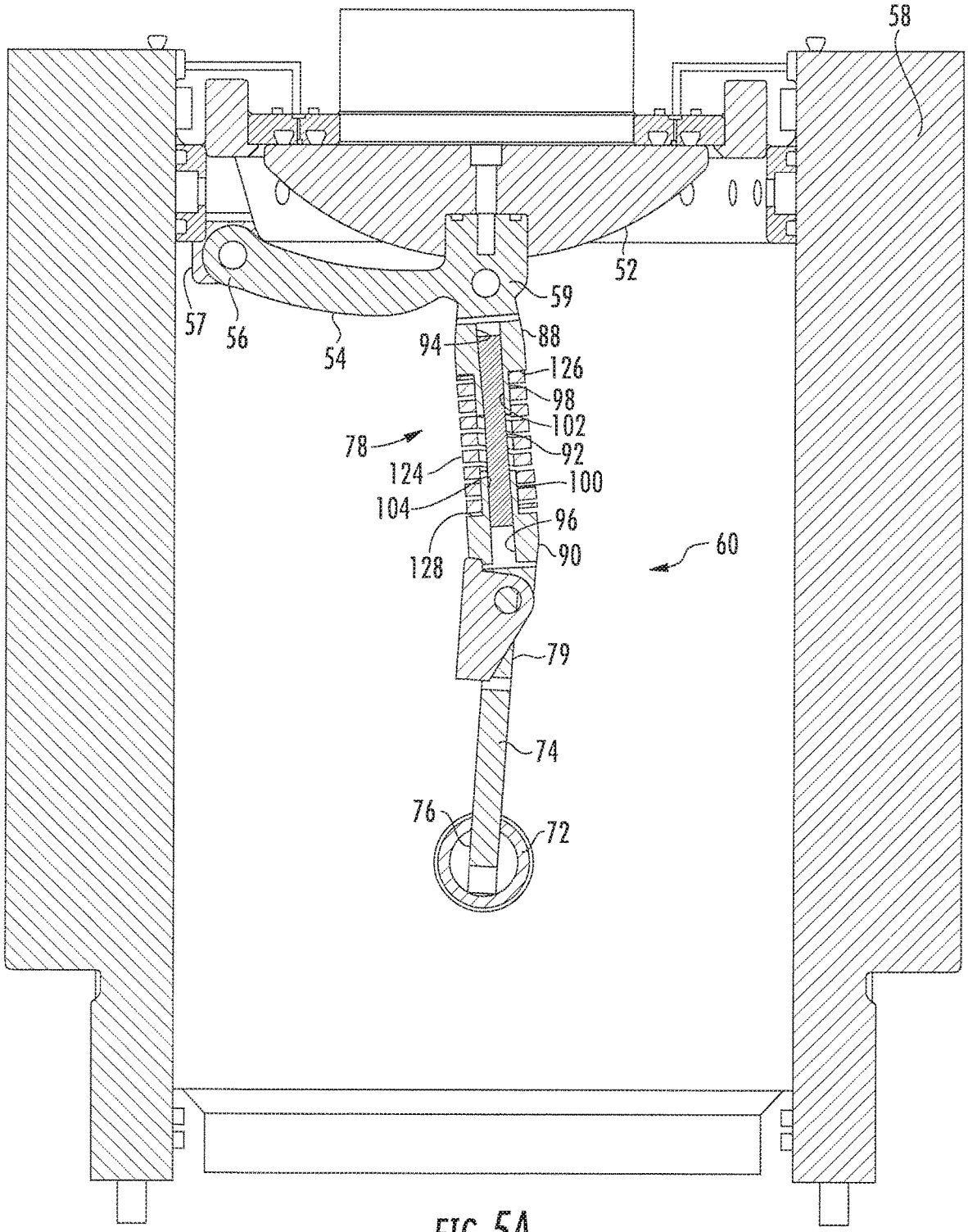
FIG. 5A is a cross-sectional view of a portion of the valve apparatus constructed in accordance with the present disclosure.
Figure 5B:
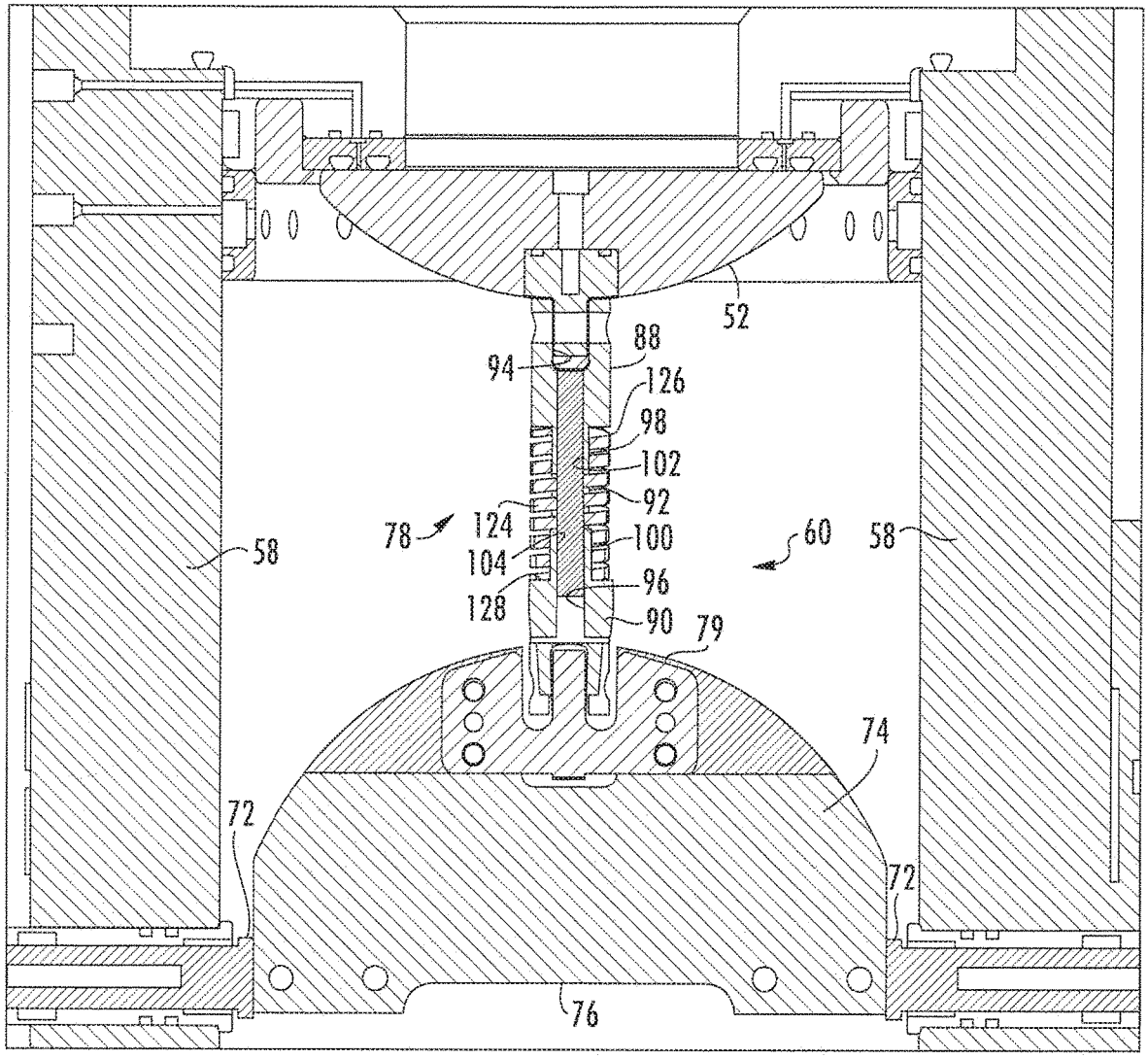
FIG. 5B is a cross-sectional view of the portion of the valve apparatus rotated 90 degrees from the view shown in FIG. 5A and constructed in accordance with the present disclosure.
Figure 5C:
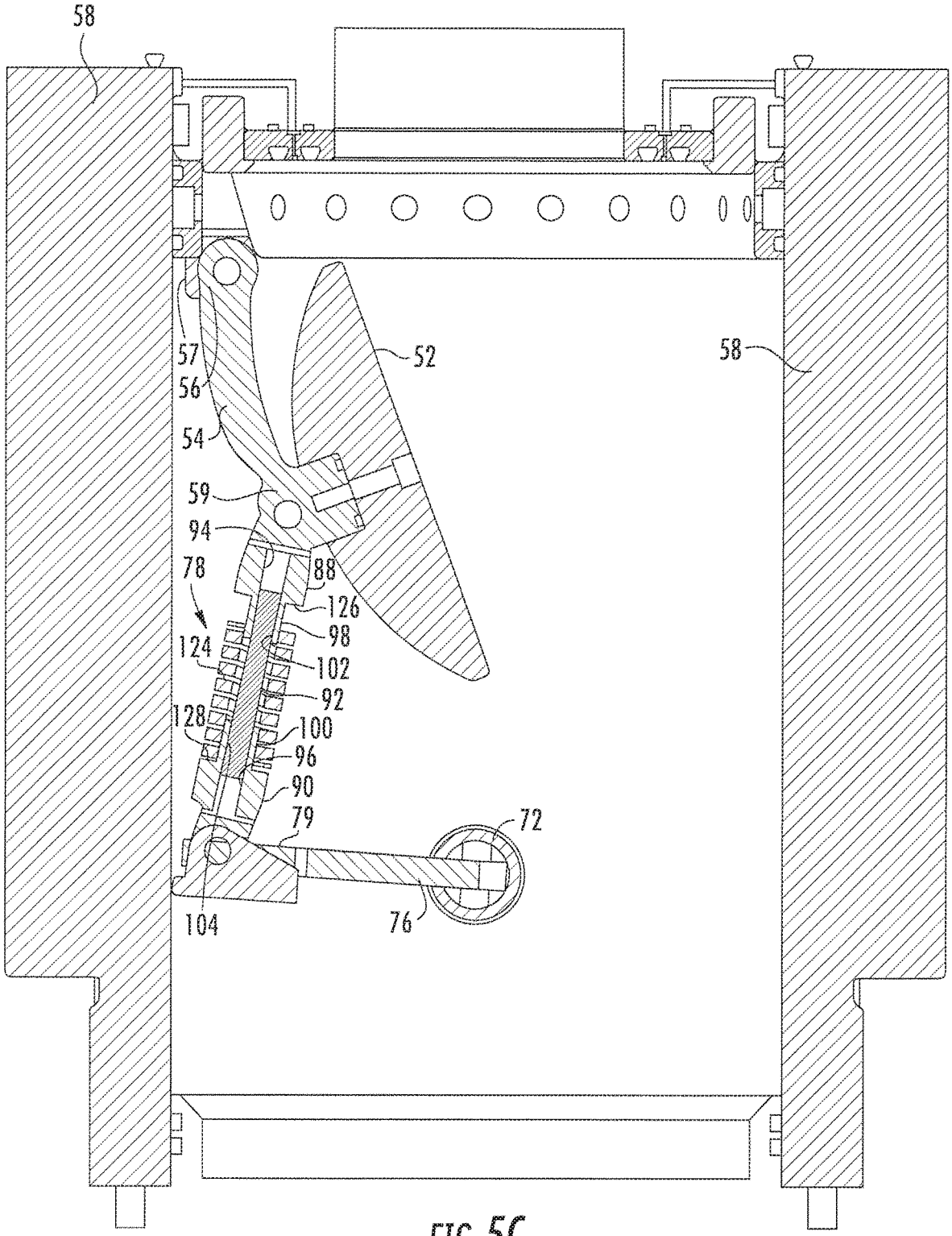
FIG. 5C is a cross-sectional view of the portion of the valve apparatus shown in FIG. 5A in a secondary position and constructed in accordance with the present disclosure.

The present disclosure relates to a valve apparatus 10 for passing an object 12 from a low pressure area (such as atmospheric conditions) to a high pressure system (such as an oil and gas well). The present disclosure is also directed to a method of passing the object 12 from the low pressure area to the high pressure system. The low pressure area and the high pressure system can be comprised of any fluid. It should be understood and appreciated that the term fluid can be a liquid, a gas, or a combination thereof.

The valve apparatus 10 can include a first containment area 14 that is maintained at the low pressure (e.g., atmospheric pressure). The valve apparatus 10 further includes a second containment area 16 disposed adjacent to the first containment area 14 and a third containment area 18 disposed adjacent to the second containment area 16 on an opposite side of the second containment area 16 from the first containment area 14. The third containment area 18 is maintained at a high pressure (the high pressure system) or a pressure that stays above the pressure in the first containment area 14. Each containment area 14, 16 or 18 can contain fluid. The type of fluid can be different in each containment area 14, 16 or 18. For example, the first containment area 14 might be air and a liquid at atmospheric conditions and the third containment area 18 might be liquid at a very high pressure (e.g., 15,000 psi). In a further embodiment of the disclosure, the first and second containment areas 14 and 16 can include funnel elements 20 and 22 disposed on lower ends of the first and second containment areas 14 and 16, respectively. The funnel elements 20 and 22 work to direct the object 12 to openings 28 and 30 disposed on upper ends 32 and 34 of the second and third containment areas 16 and 18 and pass into the second and third containment areas 16 and 18, respectively.

The valve apparatus 10 further includes a first valve 36 that separates the first containment area 14 from the second containment area 16 and a second valve 38 that separates the second containment area 16 from the third containment area 18. The pressure of the fluid in the second containment area 16 can be adjusted to be within a certain range of the first containment area 14. Adjusting the pressure of the fluid in the second containment area 16 allows the first valve 36 to open up and permit the object 12 placed into the first containment area 14 to pass into the second containment area 16. The second containment area 16 can be sized such that the object 12 can be contained therein without affecting the operation of the first valve 36. For example, the second containment area 16 would be smaller when the object 12 is a frac ball and it would be larger (taller/longer) if the object 12 was a collet.

It should be understood that when the pressure of the fluid in the second containment area 16 is outside of the certain range of the pressure of the fluid in the first containment area 14, the first valve 36 cannot be opened by the mechanical operation of the valve apparatus 10 as a safety measure. In other words, the first valve 36 cannot be opened by some operator of the valve apparatus 10 if the pressure of the fluid in the second containment area 16 is outside of the certain range of the pressure of the fluid in the first containment area 14.

To pass the object 12 from the second containment area 16 into the third containment area 18, the pressure of the fluid in the second containment area 16 is increased to be within a certain range of the pressure of the fluid in the third containment area 18. Once the pressure of the fluid in the second containment area 16 is within a certain range of the pressure of the fluid in the third containment area 18, the second valve 38 will open and permit the object 12 to pass from the second containment area 16 into the third containment area 18.

It should be understood that when the pressure of the fluid in the third containment area 18 is outside of the certain range of the pressure of the fluid in the second containment area 16, the second valve 38 cannot be opened by the mechanical operation of the valve apparatus 10 as a safety measure. In other words, the second valve 38 cannot be opened by some operator of the valve apparatus 10 if the pressure of the fluid in the third containment area 18 is outside of the pressure of the fluid in the certain range of the second containment area 16.

To manage the pressure of the fluid in the second containment area 16, the valve apparatus 10 can further include a first conduit 40 that fluidically connects the first containment area 14 to the second containment area 16 and a second conduit 42 that fluidically connects the second containment area 16 to the third containment area 18. Fluid flow control devices 44 can be used in conjunction with the first and second conduits 40 and 42 to control the flow of fluid through the first and second conduits 40 and 42.

When it is desirable for the object 12 to flow from the first containment area 14 to the second containment area 16, pressure of the fluid in the second containment area 16 has to be decreased (or potentially increased in certain circumstances) to essentially the same pressure as the pressure of the fluid in the first containment area 14 (the low pressure area). To facilitate this, the fluid flow control device 44 is manipulated to permit fluid from the second containment area 16 to flow through the first conduit 40 and into the first containment area 14. Permitting fluid to flow through the first conduit 40 from the second containment area 16 into the first containment area 14 results in the pressure of the fluid in the second containment area 16 being decreased to substantially the same pressure as the pressure of the fluid in the first containment area 14. During the operation permitting the object 12 to flow from the first containment area 14 into the second containment area 16, the second valve 38 is in the closed position.

When it is desirable for the object 12 to flow from the second containment area 16 to the third containment area 18, pressure of the fluid in the second containment area 16 has to be increased to essentially the same pressure as the pressure in the fluid in the third containment area 18 (the high pressure system). To facilitate this, the fluid flow control device 44 is manipulated to permit fluid from the third containment area 18 to flow through the second conduit 42 and to the second containment area 16. Permitting fluid to flow through the second conduit 42 from the third containment area 18 into the second containment area 16 results in the pressure of the fluid in the second containment area 16 being increased to substantially the same pressure as the pressure of the fluid in the third containment area 18. During the operation permitting the object 12 to flow from the second containment area 16 into the third containment area 18, the first valve 36 is in the closed position.

In certain situations, the pressure of the fluid in the third containment area 18 is dynamic and may be fluctuating in such a manner whereby the fluid pressure in the second containment area 16 cannot reach the substantially same pressure as the dynamic pressure of the fluid in the third containment area 18 for a sufficient amount of time to open the second valve 38. In another embodiment to combat this dynamic fluid pressure issue, the valve apparatus 10 can include an external pump 48 in fluid communication with the second containment area 16 to increase the pressure of the fluid in the second containment area 16 to a sufficient pressure to overcome the dynamic pressure of the fluid in the third containment area 18 for a sufficient amount of time and permit the second valve 38 to open. The external pump 48 can be any type of pump known in the art capable of achieving the required fluid pressures. In one exemplary embodiment, the external pump 48 can be a rod pump.

In one embodiment, the second containment area 16 can be positioned below the first containment area 14 and the third containment area 18 can be positioned below the second containment area 16. The second containment area 16 positioned below the first containment area 14 and the third containment area 18 positioned below the second containment area 16 allows the object 12 to pass from the first containment area 14 to the second containment area 16 and from the second containment area 16 to the third containment area 18 via gravity.

The first opening 28 is disposed in the lower end 24 of the first containment area 14 (or at the upper end 32 of the second containment area 16, or between the first containment area 14 and the second containment area 16) so that the object 12 placed into the first containment area 14 can pass into the second containment area 16. The second opening 30 is disposed in the lower end 26 of the second containment area 16 (or at a upper end 34 of the third containment area 18, or between the second containment area 16 and the third containment area 18) so that the object 12 passed into the second containment area 16 from the first containment area 14 can pass into the third containment area 18.

In one embodiment, the valves 36 and 38 can be flapper valves wherein the higher pressure of the fluid in the second containment area 16 over the pressure of the fluid in the first containment area 14 can maintain the closure of the first valve 36 and the higher pressure of the fluid in the third containment area 18 over the pressure of the fluid in the second containment area 16 can maintain the closure of the second valve 38. Further, the valves 36 and 38 can be opened and closed by an actuator 50 (or multiple actuators). The actuator 50 can by any type of actuator known in the art. Examples include, but are not limited to, a pneumatic actuator, a hydraulic actuator, an electrical actuator, an air over hydraulic, a manual screw or manual lever. Each valve 36 or 38 can be driven by a single actuator or multiple actuators.

The valve apparatus 10 can include a computer system 51 to monitor pressures of the containment areas 14, 16 and 18 and send signals to the fluid flow control device 44 and the actuators 50 to operate the fluid flow control device 44 and the actuators 50 in accordance with the present disclosure. The fluid flow control devices 44 can be any type of valve that can selectively permit the flow of fluid through the conduits 40 and 42. The computer system 51 can send to and receive signals from the control devices 44 and the actuators 50 via communication links 53. The communication links 53 can be hard-wired or wireless.

In one embodiment, the first valve 36 includes a flapper 52, a pivot arm 54 rotatably attached on one end 56 to a portion of a housing 58 (or a support element 57 attached to the housing 58) of the second containment area 16 and attached to the flapper 52 on a second end 59 of the pivot arm 54, and a linkage assembly 60 for transferring operation of the actuator 50 to the opening and closing of the flapper 52. The linkage assembly 60 can include any elements so that the operation of the actuator 50 is transferred to the opening and closing of the flapper 52 over the opening 28 separating the first and second containment areas 14 and 16.

In a further embodiment, the second valve 38 includes a flapper 62, a pivot arm 64 rotatably attached on one end 66 to a portion of a housing 68 (or a support element 67 attached to the housing 68) of the third containment area 18 and attached to the flapper 62 on a second end 69 of the pivot arm 64, and a linkage assembly 70 for transferring operation of the actuator 50 to the opening and closing of the flapper 62. The linkage assembly 70 can include any elements so that the operation of the actuator 50 is transferred to the opening and closing of the flapper 62 over the opening 30 separating the second and third containment areas 16 and 18.

In one exemplary embodiment of the present disclosure, the linkage assembly 60 includes a rod element 72 rotationally disposed in a portion of the housing 58 of the second containment area 16 and extending through the housing 58 to engage with the actuator 50. A planar element 74 is attached to the rod element 72 on one end 76 and rotatably attached to an extension assembly 78 on a second end 79 of the planar element 74. The extension assembly 78 is rotatably attached to the flapper 52 on the other end. The extension assembly 78 is designed such that when the planar element 74 is rotated via the rod element 72, the extension assembly 78 can extend when the flapper 52 is open and the extension assembly 78 can provide selective compressive force to the flapper 52. In one embodiment, the extension assembly 78 can be attached to the rod element 72 without the use of the planar element 74.

In a further embodiment of the present disclosure, the linkage assembly 70 includes a rod element 80 rotationally disposed in a portion of the housing 68 of the third containment area 18 and extending through the housing 68 to engage with the actuator 50. A planar element 82 is attached to the rod element 80 on one end 84 and rotatably attached to an extension assembly 86 on a second end 87 of the planar element 82. The extension assembly 86 is rotatably attached to the flapper 62 on the other end. The extension assembly 86 is designed such that when the planar element 82 is rotated via the rod element 80, the extension assembly 86 can extend when the flapper 62 is open and the extension assembly 86 can provide selective compressive force to the flapper 62. In one embodiment, the extension assembly 86 can be attached to the rod element 80 without the use of the planar element 82.

The extension assemblies 78 and 86 also function to lock the valves 36 and 38 into place when the extension assemblies are rotated to a certain position and the valves 36 and 38 are in the closed position. It is not the rotational force supplied by the actuators 50 that holds the valves 36 and 38 closed. It should be understood and appreciated that the extension assemblies 78 and 86 also experience a tensional force when the actuators 50 cause the opening of the valves 36 and 38 in the manner disclosed herein.

Figure 6A:
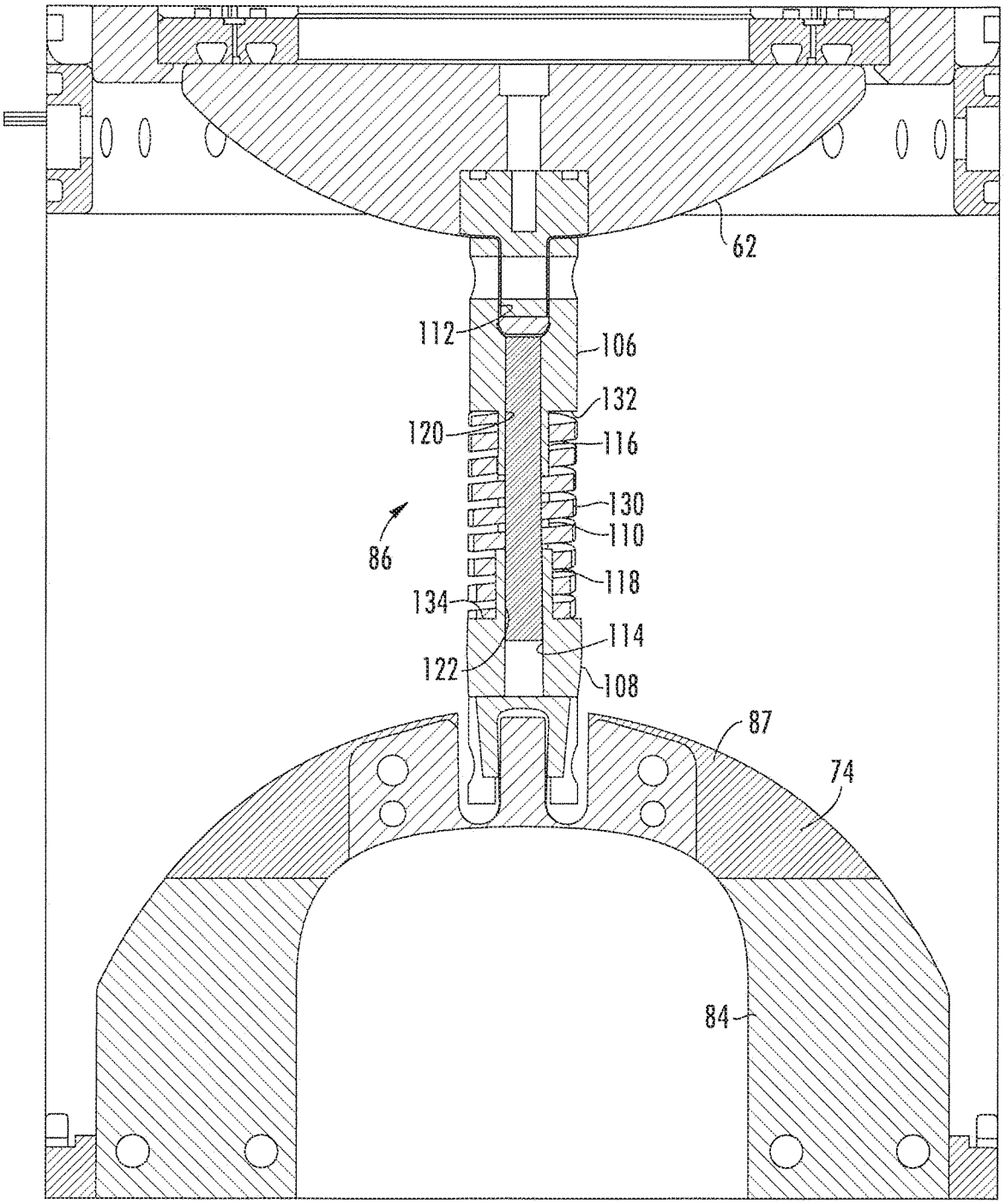
FIG. 6A is a cross-sectional view of another portion of the valve apparatus constructed in accordance with the present disclosure.
Figure 6B:
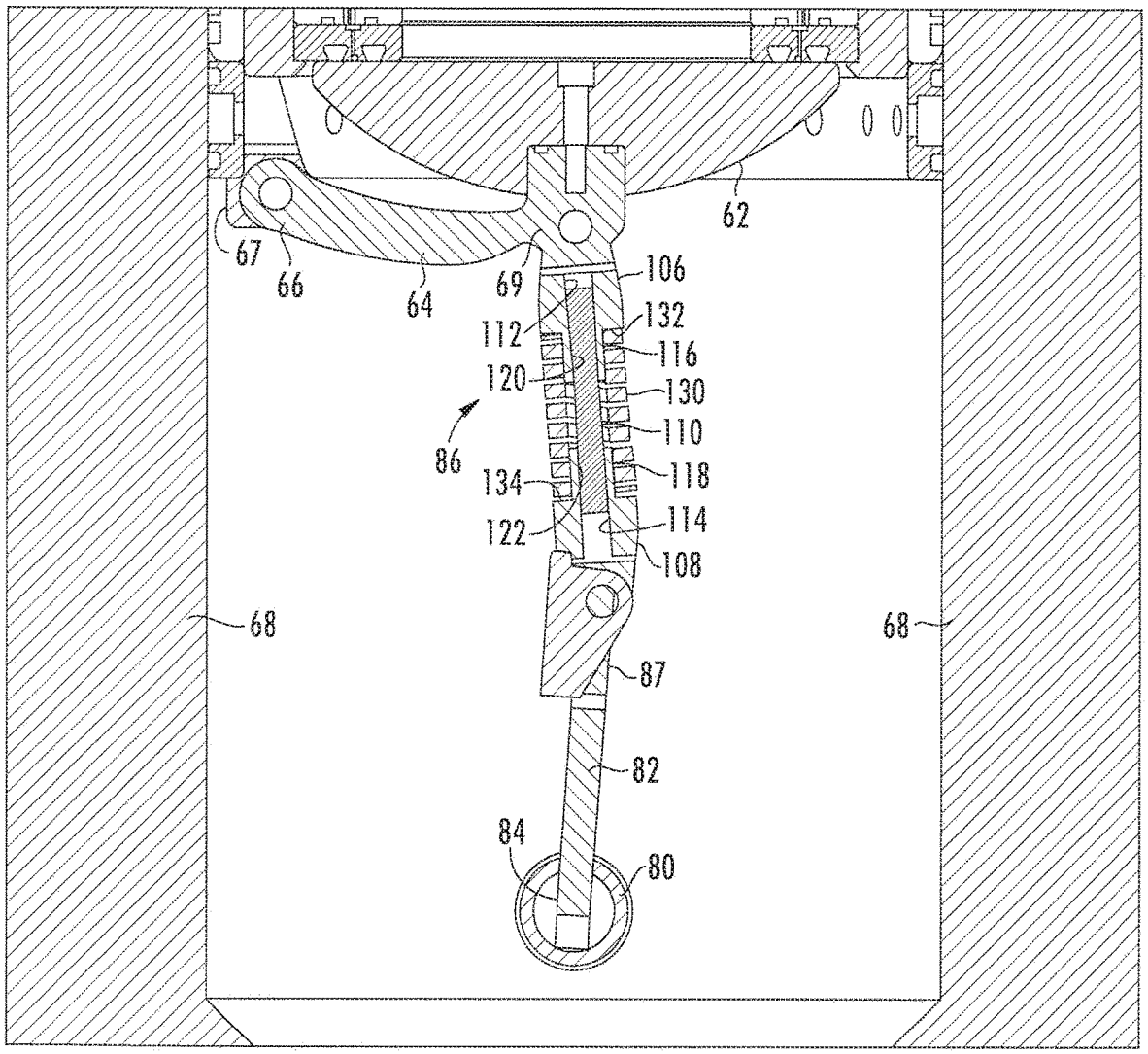
FIG. 6B is a cross-sectional view of the portion of the valve apparatus rotated 90 degrees from the view shown in FIG. 6A and constructed in accordance with the present disclosure.
Figure 6C:
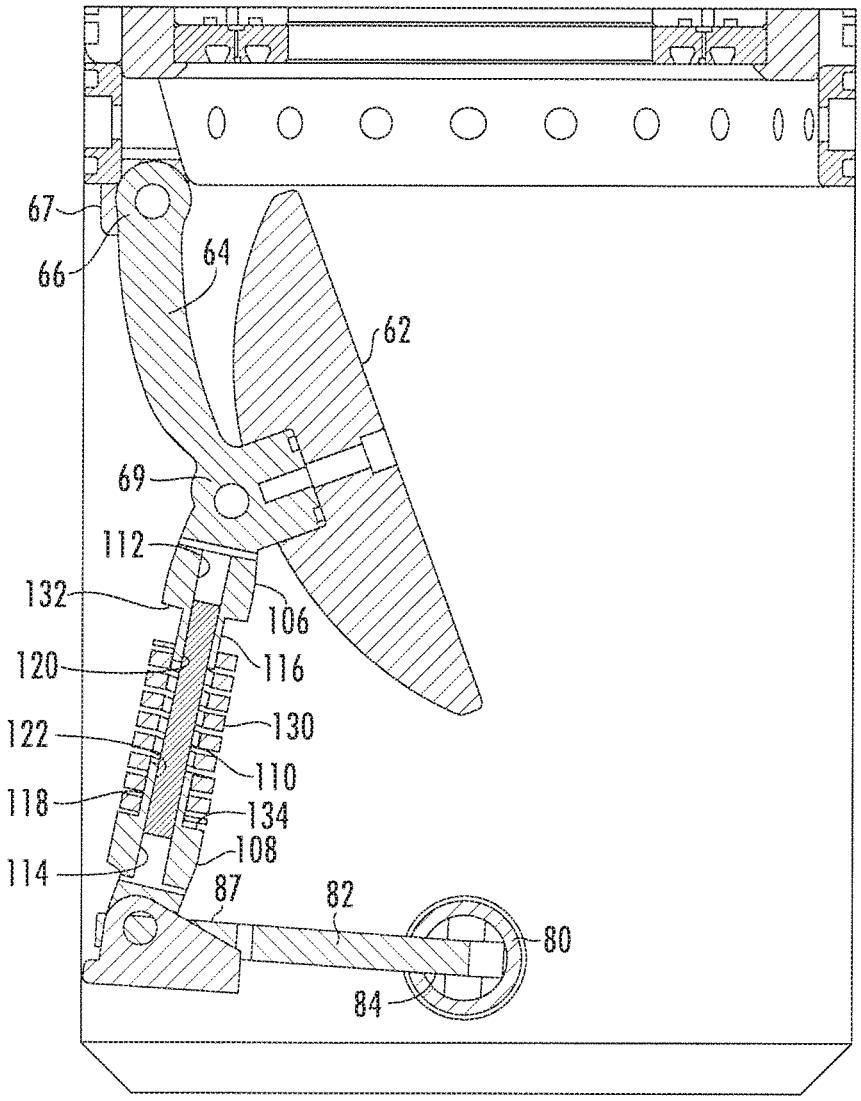
FIG. 6C is a cross-sectional view of the portion of the valve apparatus shown in FIG. 6A in a secondary position and constructed in accordance with the present disclosure.

The planar elements 74 and 82 can be any shape and size such that when the actuator 50 rotates the rod elements 72 and 80 in one direction, the extension assemblies 78 and 86 and the planar elements 74 and 82 cooperate to pull the flappers 52 and 62 open. Conversely, the planar elements 74 and 82 can be any shape and size such that when the actuator 50 rotates the rod elements 72 and 80 in the other direction, the extension assemblies 78 and 86 and the planar elements 74 and 82 cooperate to push the flappers 52 and 62 closed. In one embodiment shown in FIG. 6A, the planar element 82 has an arch shape such that when the valve 38 is opened there is more access to the center portion of the valve apparatus 10. It should be understood and appreciated that the planar element 74 can be arched shape as well.

As a safety measure, the selective compressive forces of the extension assemblies 78 and 86 allow the flappers 52 and 62 to open during situations when the pressure of the fluid in the first containment area 14 and second containment area 16, respectively, increases above a certain threshold. The extension assemblies 78 and 86 can be extendable and retractable under certain forces such that the flappers 52 and 62 could be opened in specific scenarios wherein the pressure of the fluid in the first and second containment areas 14 and 16 increases a certain predetermined amount over the pressure of the fluid in the second and third containment areas 16 and 18.

In a further embodiment, the extension assembly 78 includes a first end portion 88 rotatably attachable to the flapper 52 or the pivot arm 54, a second end portion 90 rotatably attachable to the planar element 74 and a rod 92 slidably disposed within a passageway 94 disposed in the first end portion 88 on one end and slidably disposed within a passageway 96 disposed in the second end portion 90 on the other end of the rod 92. The first end portion 88 has a sleeve portion 98 extending therefrom to receive the rod 92 and the second end portion 90 has a sleeve portion 100 to receive the rod 92. The passageway 94 disposed in the first end portion 88 is in alignment with an internal portion 102 of the sleeve portion 98, and the passageway 96 disposed in the second end portion 90 is in alignment with an internal portion 104 of the sleeve portion 100 to allow the first and second end portions 88 and 90 to slide on the rod 92.

Similarly, the extension assembly 86 includes a first end portion 106 rotatably attachable to the flapper 62 or the pivot arm 64, a second end portion 108 rotatably attachable to the planar element 82 and a rod 110 slidably disposed within a passageway 112 disposed in the first end portion 106 on one end and slidably disposed within a passageway 114 disposed in the second end portion 108 on the other end of the rod 110. The first end portion 106 has a sleeve portion 116 extending therefrom to receive the rod 110, and the second end portion 108 has a sleeve portion 118 to receive the rod 110. The passageway 112 disposed in the first end portion 106 is in alignment with an internal portion 120 of the sleeve portion 116 and the passageway 114 disposed in the second end portion 108 is in alignment with an internal portion 122 of the sleeve portion 118 to allow the first and second end portions 106 and 108 to slide on the rod 110.

In yet another embodiment of the present disclosure, the extension assembly 78 includes a compression element 124 disposed around the rod 92, the sleeve portion 98 of the first end portion 88, and the sleeve portion 100 of the second end portion 90. The compression element 124 is also disposed between a shoulder 126 disposed on the first end portion 88 and a shoulder 128 disposed on the second end portion 90 of the extension assembly 78. Similarly, the extension assembly 86 includes a compression element 130 disposed around the rod 110, the sleeve portion 116 of the first end portion 106 and the sleeve portion 118 of the second end portion 108. The compression element 130 is also disposed between a shoulder 132, disposed on the first end portion 106 and a shoulder 134, disposed on the second end portion 108 of the extension assembly 86. The compression elements 124 and 130 provide additional control of the flappers 52 and 62 when pressure of the fluid above it is increased a certain amount above the fluid disposed below the flapper. In one embodiment, the compression elements 124 and 130 are springs.

In another embodiment, the rod elements 72 and 80 of the linkage assemblies 60 and 70 can be comprised of more than one component and multiple actuators 50 to permit more efficient rotational force to be applied to planar elements 74 and 82.

In a further embodiment, the valve apparatus 10 can be used with an oil and gas operation to permit the passing of frac balls down into an oil and gas well to be able to selectively fracture various zones in a formation. In this scenario, the low pressure area would be any device capable of housing the frac balls prior to them being passed through the valve apparatus 10 and into the well (the high pressure system or third containment area 18).

The valve apparatus 10 can have additional uses aside from passing objects, such as frac balls, collets, soap sticks, etc., from a low pressure area to a high pressure area. The valve apparatus 10 can also be used in any oil field application that requires equalization capabilities and the valve apparatus 10 can be used for equalization with tethered tools, such as wireline tools and coiled tubing. The design of the valve apparatus 10 when implementing flapper valves for the first and second valves 36 and 38 is designed to have a much longer life cycle than other tools which perform similar functions.

When the valve apparatus 10 is used in conjunction with tethered tools, the valve apparatus 10 can only include a first containment area 14 and the third containment area 18 and only one valve 36 or 38 disposed therebetween. Thus, when used with tethered tools, the valve apparatus 10 only requires a single valve 36 or 38. It should be understood that if only the first valve 36 is implemented then the second and third containment areas 16 and 18 merge to form a single containment area. Similarly, if only the second valve 38 is implemented then the first and second containment areas 14 and 16 merge to create a single containment area.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A well valve apparatus configured to mount atop a well, the valve apparatus comprising:

a first containment area configured to hold a fluid disposed therein at a first fluid pressure;

a second containment area disposed below the first containment area and configured to hold a fluid disposed therein at a selective fluid pressure where the selective fluid pressure can be increased and decreased, the second containment area in fluid communication with the first containment area;

a first valve disposed between the second containment area and the first containment area and closeable to seal the second containment area from the first containment area, the first valve being a flapper valve oriented to open toward the second containment area;

a first fluid conduit between the first containment area and the second containment area, the fluid conduit configured to selectively communicate fluid between the first containment area and the second containment area while the first valve is closed;

a third containment area disposed below the second containment area configured to hold a fluid disposed therein at a third fluid pressure that is higher than the first fluid pressure, the second containment area in fluid communication with the third containment area;

a second valve disposed between the third containment area and the second containment area and closable to seal the second containment area from the third containment area; and a second fluid conduit between the second containment area and the third containment area, the second fluid conduit configured to selectively communicate fluid between the second containment area and the third containment area while the second valve is closed, and wherein the pressure of the fluid in the second containment area is increased via communicating pressure of the fluid in the third containment area into the second containment area through the second fluid conduit; and wherein the valve apparatus comprises an actuator compliantly coupled to the first valve, the actuator changeable between an open position actuating the first valve open and a closed position actuating the first valve closed, and where a compliance allows the first valve to open, despite the actuator being maintained in the closed position, in response to the first fluid pressure being greater than the second fluid pressure.

2. The apparatus of claim 1 wherein the first fluid pressure is atmospheric pressure.

3. The apparatus of claim 1 wherein the pressure of the fluid in the second containment area is decreased via ejecting fluid from the second containment area into the first containment area through the first fluid conduit.

4. The apparatus of claim 1 wherein the first valve or the second valve is a flapper valve.

5. The apparatus of claim 4 wherein the flapper valve opens downward.

6. The apparatus of claim 1 further comprising:

a first linkage assembly and at least one actuator cooperating to open and close the first valve; and a second linkage assembly and at least one actuator cooperating to open and close the second valve.

7. The apparatus of claim 6 wherein the first linkage assembly comprises:

a first rod element rotatably disposed through a portion of a housing of the valve apparatus and rotatable by an actuator; and a first extension assembly attached to the first rod element on one end and attached to the first valve on an opposite end of the first extension assembly.

8. The apparatus of claim 7 wherein the second linkage assembly comprises:

a second rod element rotatably disposed through a portion of a housing of the valve apparatus and rotatable by an actuator; and a second extension assembly attached to the second rod element on one end and attached to the second valve on an opposite end of the second extension assembly.

9. The apparatus of claim 8 where in the first linkage assembly comprises a first planar element disposed between the first rod element and the first extension assembly, the first planar element and the first extension assembly having different centers of rotation during actuation, and wherein the second linkage assembly includes a second planar element disposed between the second rod element and the second extension assembly, the second planar element and the second extension assembly having different centers of rotation during actuation.

10. The apparatus of claim 9 wherein the first extension assembly includes a first end portion attachable to the first valve, a second end portion attached to the first planar element, a first rod slidably disposed within the first and second end portions, and a compression element to supply compressive force to the first valve; and the second extension assembly includes a third end portion attachable to the second valve, a fourth end portion attached to the second planar element, a second rod slidably disposed within the third and fourth end portions, and a second compression element to supply compressive force to the second valve.

11. The apparatus of claim 10 wherein the first and second compression elements are springs disposed around the first rod and the second rod, respectively.

12. The apparatus of claim 1 further comprising:

a computer system configured to:

monitor pressure of fluids disposed in the containment areas, send signals to at least one fluid flow control device in each of the first and second fluid conduits to permit fluid to flow through the first or second fluid conduit, and send signals to at least one actuator to open or close the first or second valve.

13. The valve apparatus of claim 12, wherein the computer system is further configured to:

receive a signal indicative of receiving an object within the first containment area, send a signal to change a pressure of a second containment area to match a pressure of the first containment area, send a signal to actuate the first valve to pass the object from the first containment area to the second containment area, send a signal to change a pressure within the second containment area to match the pressure of a third containment area, and send a signal to actuate the second valve to pass the object from the second containment area to the third containment area.

14. The valve apparatus of claim 1, wherein the compliance comprises a linkage compliantly coupling the first valve and the actuator, the linkage comprising a spring configured to compress and allow the first valve to open, without operation of the actuator, in response to the first fluid pressure being greater than the second fluid pressure.

15. The valve apparatus of claim 1, wherein the actuator is compliantly coupled to the first valve with a compliance that allows the first valve to open, without operation of the actuator, in response to the first fluid pressure being a specified amount above the second fluid pressure.

16. The valve apparatus of claim 1, wherein the second valve comprises a second flapper valve oriented to open toward the second containment area; and wherein the valve apparatus comprises a second actuator compliantly coupled to the second valve by a compliance to operate the second valve open and closed and wherein the compliance allows the second valve to open, without operation of the actuator, in response to the second fluid pressure being greater than the first fluid pressure.

17. The valve apparatus of claim 1, wherein the first containment area and the second containment area are adjacent to one another.

18. The valve apparatus of claim 1, wherein the second containment area and the third containment area are adjacent to one another.

19. The valve apparatus of claim 1, wherein allowing the first valve to open is of a sufficient amount and duration to reduce a pressure differential between the first containment area and the second containment area a set amount.

20. A method comprising:

receiving an object within a first containment area of a valve apparatus mounted atop a well, the first containment area sealed from a second containment area of the valve apparatus by a closed first flapper valve, wherein the valve apparatus comprises an actuator compliantly coupled to the first flapper valve, the actuator changeable between an open position actuating the first flapper valve open and a closed position actuating the first flapper valve closed, and where a compliance allows the first flapper valve to open, without operation of the actuator, in response to the first fluid pressure being greater than the second fluid pressure;

communicating fluid between the first containment area and the second containment area through a first conduit while the first flapper valve is closed;

passing the object from the first containment area to the second containment area by opening the first flapper valve;

commuting fluid between the second containment area and a third containment area while the second containment area is sealed from the third containment area by a closed second valve; and passing the object from the second containment area to a third containment area by opening the second valve.

21. The method of claim 20, further comprising the step of decreasing the pressure of the fluid in the second containment area to a pressure within a certain range of the pressure of the fluid within the first containment area to allow the first valve to open and permit the object to pass from the first containment area into the second containment area.

22. The method of claim 21, further comprising the step of increasing the pressure of the fluid in the second containment area to a pressure within a certain range of the pressure of the fluid within the third containment area to allow the second valve to open and permit the object to pass from the second containment area into the third containment area.

23. The method of claim 20, wherein the first valve and the second valve comprise:

a first linkage assembly and at least one actuator cooperating to open and close the first valve; and a second linkage assembly and at least one actuator cooperating to open and close the second valve.

24. The method of claim 23 wherein the first linkage assembly comprises:

a first rod element rotatably disposed through a portion of a housing of the first valve and rotatable by an actuator; and a first extension assembly attached to the first rod element on one end and attached to the first valve on an opposite end of the first extension assembly; and the second linkage assembly comprises:

a second rod element rotatably disposed through a portion of a housing of the second valve and rotatable by an actuator; and a second extension assembly attached to the second rod element on one end and attached to the second valve on an opposite end of the second extension assembly.

25. The method of claim 20, comprising:

communicating fluid between the second containment area and the third containment area through a second conduit in fluid communication with the second containment area and the third containment area; and monitoring pressure of fluids disposed in the containment areas, sending signals to at least one fluid flow control device in the first or second conduit to permit fluid to flow through the desired first or second conduit, and sending signals to at least one actuator to open or close the first or second valve.

* * * * *